United States Patent [19]

Zimmer et al.

[11] 4,182,660

[45] Jan. 8, 1980

[54] METHOD OF PRODUCING A PERFORATED METAL FOIL

[75] Inventors: Peter Zimmer; Hans Kudlich, both of Kufstein; Karl Schweitzer, Oberlangkampfen, all of Austria

[73] Assignee: Maschinenfabrik Peter Zimmer Aktiengesellschaft, Kufstein, Austria

[21] Appl. No.: 897,054

[22] Filed: Apr. 17, 1978

[30] Foreign Application Priority Data

Apr. 18, 1977 [AT] Austria ..... 2705/69

[51] Int. Cl.[2] ..... C25D 1/08

[52] U.S. Cl. ..... 204/11; 427/256; 427/425

[58] Field of Search ..... 204/11; 427/256, 287, 427/421, 425

[56] References Cited

U.S. PATENT DOCUMENTS 2,765,230 10/1956 Tinklenberg ..... 204/11

3,434,938 3/1969 Van Sciver ..... 204/11

FOREIGN PATENT DOCUMENTS 1202610 10/1965 Fed. Rep. of Germany ..... 204/11

*Primary Examiner*—T. M. Tufariello

*Attorney, Agent, or Firm*—Montague & Ross

[57] ABSTRACT

To produce a perforated metal foil, especially for use in a screen printer, a decomposable, dissoluble or vaporizable dielectric substance is deposited on a cylindrical conductive substrate in a dot pattern under the control of a photoelectrically scanned master. The spaces between the dots are then filled with an electrolytically deposited metal forming a coherent layer which is subsequently stripped off the substrate. The deposition of the dot pattern is carried out through a spray nozzle, sweeping the rotating substrate, which has an outlet in a bottom wall of a narrow space filled with the liquid dielectric to be dispensed, that space being separated by an apertured partition from an overlying plenum chamber in which the air is intermittently pressurized by an electromagnetic armature to expel a limited quantity of dielectric through the outlet; the membrane may be vibrated at supersonic frequencies to generate the necessary discharge pressure.

5 Claims, 3 Drawing Figures

METHOD OF PRODUCING A PERFORATED METAL FOIL

FIELD OF THE INVENTION

Our present invention relates to the production of metal foils with a selected pattern of fine perforations, especially for use in a cylindrical printing screen.

BACKGROUND OF THE INVENTION

The conventional way of making such perforated foils involves the application of a photosensitive layer to a metallic substrate and the selective removal of certain parts of that layer by a development process after exposure to illumination through a mask bearing the desired pattern. The portions of the layer remaining on the substrate form a pattern of isolated dots around which a coherent metallic layer (e.g. of copper) can be built up by electrolytic deposition. When this metallic layer is stripped off the substrate, and upon removal of the dots of photosensitive material (which could take place either before or after the stripping step), it is ready for use in screen printing.

In commonly owned U.S. Pat. application Ser. No. 781,063 filed by Siegfried Ruckl on Mar. 24, 1977, now U.S. Pat. No. 4,118,288, there has been disclosed and claimed a process of this general type designed to obviate a drawback of the aforedescribed technique, namely the fact that the electrolytically deposited metal tends to grow laterally into areas occupied by the dot pattern so that the resulting perforations in the foil are smaller in diameter than the original dots. The process of that application and patent involves an increase in the porosity of the photosensitive-layer portions left on the substrate, allowing these portions to swell upon being contacted with moisture (e.g. during the developing step) so as to reduce the intervening interstices to be occupied by the galvanically deposited metal.

OBJECT OF THE INVENTION

The object of our present invention is to provide a method of producing such a dot pattern on a substrate without the need for a selective exposure of a photosensitive layer through an optical mask conforming to the desired perforation distribution.

SUMMARY OF THE INVENTION

In accordance with our present invention, a hardenable and preferably dielectric substance is spread in the form of tiny dots onto a preferably metallic substrate at isolated locations corresponding to those of the perforations in the selected pattern. These dots, which no longer have to consist of photosensitive material (although the use of such a material is by no means excluded), can then be embedded in a coherent metallic layer deposited on the substrate by the usual electrolytic process, for example. As with the conventional method, the sites of the metallic layer occupied by the dot-forming substance are cleared either before or after removal of the layer from its substrate, e.g. by decomposition, dissolution or vaporization.

A wide variety of hardenable substances can be utilized with our present method. These include organic solutions of thermoplastic resins such as polyvinylchloride or polyethylene, for example, as well as polysaccharides and other gels. The use of substances such as polysaccharides, which swell in the presence of moisture, is advantageous in that it allows an expansion of the deposited dots to counteract the aforementioned growth tendency of the metallic layer. The expansion of such a swellable substance can be thermally controlled during electrodeposition, continuously or in steps, to maintain the desired perforation diameter. Other heat-activable expanding or foaming agents usable for this purpose include urea compounds, azodicarbonamide, 1,3-benzoldisulfonohydrazide, dinitrosopentamethylenetetramine, 5-morpholyl-1,2,3,4-thiotriazole, or azoisobutyric nitrile; the latter, for instance, gives off nitrogen at temperatures above 100° C.

An apparatus for carrying out the aforedescribed method advantageously comprises a rotatable cylinder which constitutes or carries the substrate designed to receive the hardenable substance in a selected dot pattern. A nozzle, to which that substance is fed in liquid form from a source such as a storage tank, is mounted on a support that is axially displaceable along the outer surface of the cylinder with the aid of drive means also serving to rotate the cylinder about its axis, the nozzle sweeping the cylinder surface in a succession of closely adjoining turns. During this sweep, the nozzle is intermittently actuated by a pulse generator to form tiny dots of the hardenable substance in an array determined by a programmer which may comprise a cylindrical carrier of a master pattern, jointly rotating with the cylinder, subjected to photoelectric scanning.

Suitable nozzles have been disclosed in commonly owned U.S. patent applications Ser. No. 709,550, filed by one of us (Hans Kudlich) on July 28, 1976, and Ser. No. 887,833, filed by us jointly with Walter Mayr on March 17, 1978.

A modified nozzle, particularly adapted for use with such an apparatus comprises a housing whose bottom wall has an outlet orifice overlain by a narrow space which is separated by an apertured partition from a plenum chamber bounded by an oscillatable membrane. The space above the orifice communicates with the source of hardenable liquid substance so as to be continuously filled with sprayable mass, yet the orifice is sufficiently restricted to prevent the escape of any part of that mass by gravity unless pressure is exerted upon the plenum chamber through the membrane by operating means such as an electromagnetic coil energizable by the pulse generator. We have found, that an effective discharge of a measured quantity of sprayable substance through such a restricted orifice is achieved if the membrane is vibrated in short bursts of supersonic oscillations.

BRIEF DESCRIPTION OF THE DRAWING

The above and other features of our invention will now be described in detail with reference to the accompanying drawing in which.

SPECIFIC DESCRIPTION

Figures 1, 3:
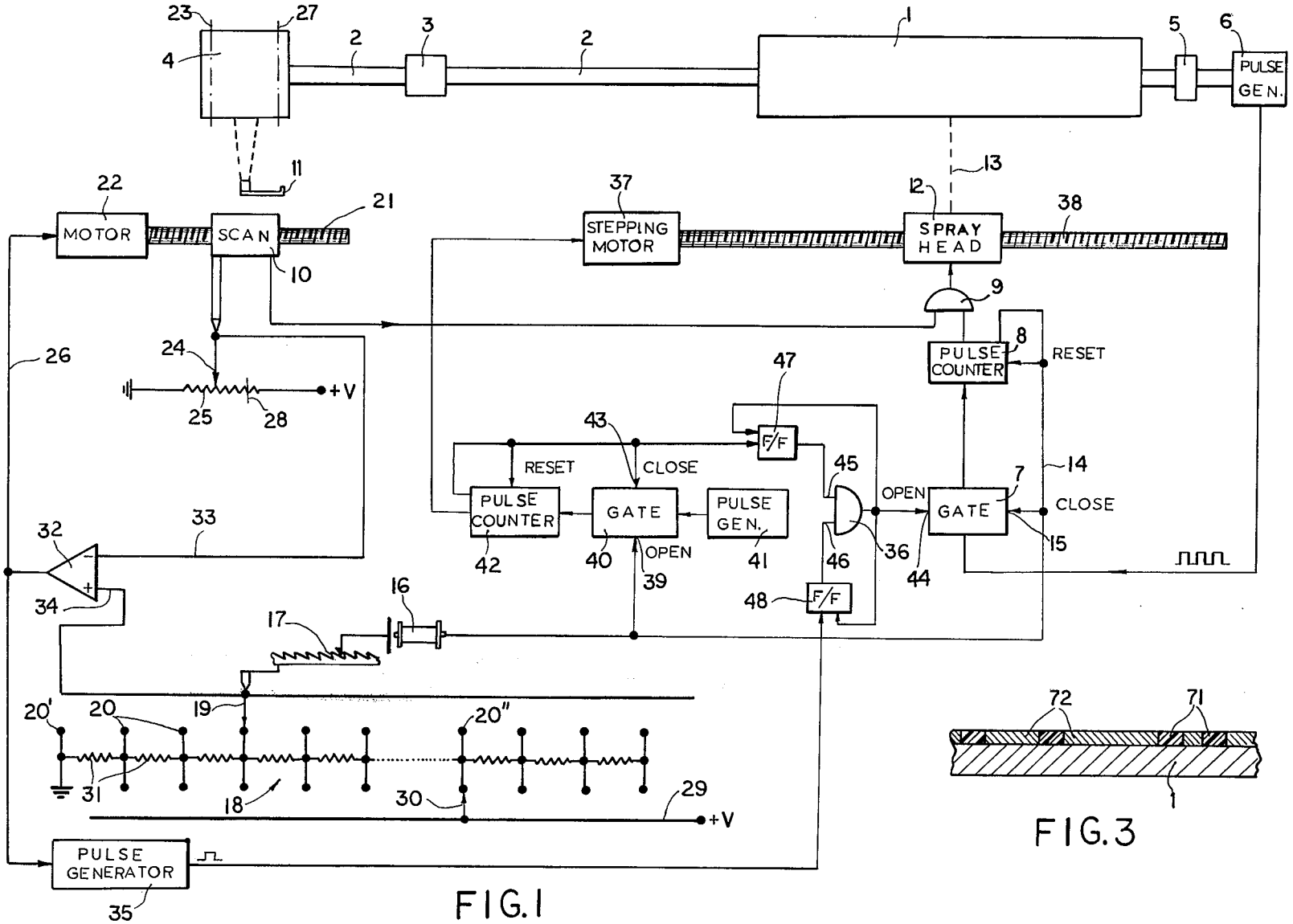
FIG. 1 is a largely diagrammatic representation of an apparatus for producing perforated metal foils in accordance with our invention.
FIG. 3 is a fragmentary sectional view of a cylinder included in the apparatus, illustrating a pattern of non-conductive dots and a coherent metallic layer deposited thereon.

As illustrated in FIG. 1, a cylindrical mandrel 1 of a suitable metal—e.g. nickel—is connected by a shaft 2 and a preferably adjustable gear transmission 3 with a cylindrical carrier or drum 4 centered on the same axis. A nonillustrated master on drum 4, bearing a color pattern to be recurrently reproduced in an array of perforations on a metallic foil serving as a printing screen, rotates at a speed which may be equal to or a multiple of that of cylinder 1; for this purpose, transmission 3 may have a step-down ratio variable in integral steps between 1:1 and 1:5, for example.

The rotation of cylinder 1 is transmitted, via a further coupling 5, to a pulse generator 6 stepping a pulse counter 8 by way of an electronic gate 7. The transmission ratio of coupling 5 may be so chosen that, for every centimeter of travel measured on the cylinder surface, the number of pulses emitted by generator 6 ranges between, say, 7 and 32, depending on the desired density of the pattern. If the circumference of the cylinder 1 measures between 50 and 80 cm, as is usual, the number of pulses per revolution will range from 350 to 2,560. Pulse generator 6 may comprise a cylindrical sleeve with a photelectrically scanned inner or outer surface carrying dark lines on a light background, or vice versa, whose density determines the pulse rate. If the coupling 5 is a step-up transmission, the number of scanning lines to be sensed by a photocell can be a small fraction of the total referred to above. Reference may be made, in this connection, to commonly owned U.S. Pat. No. 4,010,320.

In the open state of gate 7, counter 8 passes the arriving pulses to an input of an AND gate 9 whose other input is connected to a photoelectric scanner 10 confronting the drum 4. A turret 11, located between a photocell of scanner 10 and the master, may carry a multiplicity of color filters selectively interposable in the light path of the scanner to determine a particular color component in the master pattern whose distribution is to be duplicated in the array of perforations of the printing screen to be produced. In the presence of the selected color component, therefore, gate 9 passes the pulses from generator 6 to activate a nozzle head 12, in a manner more fully described hereinafter, which is intermittently displaceable along the cylinder 1 by a leadscrew 38 driven by a stepping motor 37. Such activation results in the squirting of a hardenable dielectric substance, of the type already discussed, upon the cylinder surface as schematically indicated at 13. For the sake of clarity we have shown the nozzle discharge 13 as a long line even though, as pointed out in application Ser. No. 709,550 referred to above, the head 12 ought to be closely spaced from the cylinder surface.

Gate 7 is of the type having two collateral inputs 15 and 44 which, when energized, respectively set and reset an internal flip-flop rendering the gate conductive only in its reset state. Thus, inputs 15 and 44 have a blocking and an unblocking function in respectively closing and opening the gate.

Pulse counter 8, upon reaching the count to which it has been preset, energizes a lead 14 connected to its own resetting input and also to blocking input 15 of gate 7 to inhibit further pulsing of spray head 12. Lead 14 extends to a stepping magnet 16 which controls a pawl-and-ratchet drive 17 to advance a slider 19 connecting a lead 34 to any of several taps 20 of a voltage divider 18. Lead 34 extends to an input of a differential amplifier 32 whose other input is tied to a lead 33 emanating from a slider 24 of a potentiometer 25 connected between positive voltage +V and ground. The same positive voltage +V is applied to a conductor 29 tied to a connector 30 which is selectively engageable with potentiometer taps 20 for varying the number k of resistance elements 31 lying between voltage +V and ground. Slider 24 is entrained by the scanner 10 which is intermittently displaced by a leadscrew 21, driven by a motor 22, parallel to the axis of cylinder 4 to scan the master carried thereon. The master pattern starts at a line 23 and ends at a line 27. The contact receiving the voltage +V via connector 30 has been designated 20''. Motor 22 is energized via an output lead 26 of a amplifier 32.

At the start of a reproduction cycle, scanner 10 is in a left-hand position registering with line 23 while slider 24 stands at the grounded end of potentiometer 25. Slider 19 engages its extreme left-hand contact 20' which is also grounded. Since the two inputs of amplifier 32 are at the same potential, no output voltage appears on lead 26. With gate 7 initially open, nozzle head 12 is iteratively actuated until cylinder 1 has made a full revolution. At this point the counter 8 energizes the lead 14 and resets itself to zero, blocking the gate 7 and causing the advance of slider 19 by one step as described above. Amplifier 32 now has an output which energizes the motor 22 to drive the leadscrew 21 until the scanner 10 reaches a position in which the potential of slider 24 matches that of slider 19. At this instant the motor 22 stops while a one-shot pulse generator 35, connected to lead 26, responds to the disappearance of voltage from that lead by setting a flip-flop 48 whose set output is tied to an input 46 of an AND gate 36. An electronic gate 40 of the same type as gate 7, in series with a continuously operating pulse generator 41, has an unblocking input 39 tied to lead 14 so that a train of pulses emitted by generator 41 passes through a counter 42 to stepping motor 37. The axial shift of the nozzle head 12 by means of leadscrew 38, in the same direction (here left to right) as that of scanner 10, starts with the resetting of counter 8 and thus substantially at the same time as the operation of motor 22 due to the displacement of slider 19; nozzle head 12 stops when the contents of counter 42 have reached a preset numerical value corresponding to the desired axial spacing of successive peripheral rows of dots on cylinder 1. When this count is reached, counter 42 resets itself, energizes a blocking input 43 of gate 40 and sets a flip-flop 47 whose set output is tied to the other input 45 of AND gate 36. With the setting of both flip-flops 47 and 48, AND gate 36 conducts and energizes the unblocking input 44 of gate 7 while resetting the two flip-flops.

It will be understood that a revolution of cylinder 1, corresponding to a full count of pulse counter 8, may encompass one or more revolutions of drum 4, depending on the step-down ratio of transmission 3. The reopening of gate 7 at the beginning of a new revolution of cylinder 1 restarts the aforedescribed sequence of operations, except that slider 19 now stands on the second contact 20 and scanner 10 as well as nozzle head 12 assumes a corresponding axial position. It will be apparent that the extent of the axial shift of scanner 10 from one cylinder revolution to the next depends on the setting of connector 30, i.e. on the number k of potentiometer sections 31 lying between voltage +V and ground.

When, after a cycle of k axial shifts, scanner 10 has arrived at the line 27 marking the end of the master pattern while slider 24 has reached its final position 28, nozzle head 12 may have advanced over only a fractional zone of cylinder 1 so that the same procedure will have to be repeated on an adjoining zone. For this purpose it will be necessary to reverse the rotation of leadscrew 21 by motor 22 and to return the slider 19 to the first contact 20' by a nonillustrated resetting mechanism while gates 7 and 40 remain closed. In order to avoid the interruption of the spraying operation during the return of scanner 10 to its initial position, we may provide a second scanner driven in the opposite direction to which the left-hand input of AND gate 9 is switched upon the reversal of motor 22 (or of a transmission linking that motor with leadscrew 21 and its mate), in the manner described in the aforementioned U.S. Pat. No. 4,010,320. With a transmission ratio of 1:1 between cylinders 4 and 1 it would also be possible to substitute a continuous helical sweep for the intermittent motions of scanner 10 and nozzle head 12. The need for a resetting of slider 19 can be obviated if resistances 31 are arrayed in a circle, interrupted between contacts 20" and 20', on a rotating disk stepped by magnet 16; the sliders of several such circles, differing as to the number of sections 31, could then be selectively connected to amplifier input 34.

Figure 2:
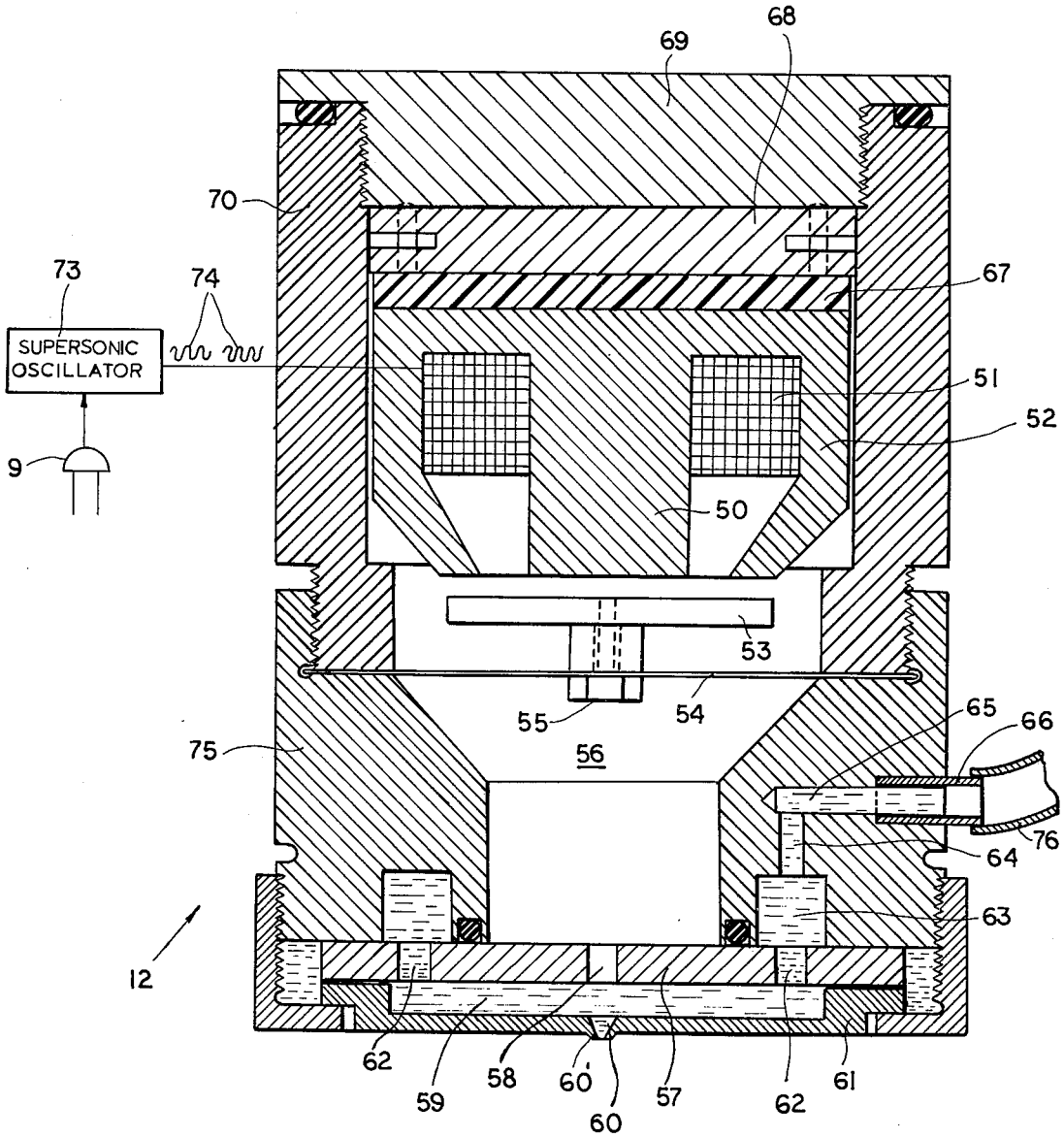
FIG. 2 is an axial sectional view of a nozzle adapted to be used in the apparatus of FIG. 1.

In FIG. 2 we have shown a preferred embodiment of nozzle head 12. A core 50 of ferromagnetic material is surrounded by a coil 51 which is energizable by an oscillator 73, during conduction of AND gate 9, with alternating-current bursts 74 of supersonic frequency. Core 50 is integral with a ferromagnetic shell 52 and coacts with an armature 53 secured to a resilient membrane 54 by a screw 55. Membrane 54, clamped in position between a nonmagnetic housing 70 and an associated base 75, forms the upper boundary of a plenum chamber 56 separated at its bottom by a partition 57 from a narrow fluid space 59 communicating with chamber 56 via an aperture 58. This aperture is in line with a restricted discharge orifice 60 in the bottom 61 of space 59.

A mass of hardenable liquid substance, to be sprayed upon the cylinder 1 of FIG. 1, constantly fills the fluid space 59 to which it is admitted from a nonillustrated source through several ports 62 communicating with an annular channel 63. A nipple 66, connected to the source by a tube 76, opens into channel 63 by way of bores 64 and 65.

The ferromagnetic structure 50, 52 with coil 51 is held in position within housing 70 by a dielectric plate 67, e.g. of phenolformaldehyde resin, carried on an aluminum disk 68 which is secured to a lid 69.

The downwardly tapering orifice 60 is so dimensioned, in relation to the viscosity of the substance to be sprayed, as to prevent that substance from leaving the space 59 as long as membrane 54 is not subjected to supersonic vibrations by oscillator 73. The high-frequency pneumatic impulses generated in chamber 56 by these vibrations expel a measured quantity of liquid in short squirts through the orifice onto the immediately underlying substrate.

Advantageously, as also pointed out in the above-identified commonly owned application Ser. No. 887,833, the outlet end of orifice 60 is surrounded by an annular ridge 60' designed to cut off the stream of liquid upon the cessation of the driving impulses and to prevent leakages onto the surrounding undersurface of housing bottom 61. That undersurface may also be provided with narrow grooves occupied by absorbent pads, as shown in that earlier application, or connected to a suction channel through which any overflow may be aspirated from time to time.

FIG. 3 shows part of the cylinder 1 with dots 71 formed thereon by the nozzle head 12 as described above. The interstices between these isolated dots are shown occupied by a metallic layer 72 built up on the substrate 1 by electrodeposition to form a coherent foil which, after removal of the dielectric inserts 71, has a pattern of perforations corresponding to the distribution of the selected color component on the master carried by drum 4. If the dielectric material forming these inserts 71 is of photosensitive character, its removal can be carried out by a developer after illumination of the foil.

We claim:

1. In a method of providing a metal foil with a predetermined pattern of fine perforations by forming a corresponding pattern of tiny dots on a substrate and thereafter covering the interstices between the dots with a coherent electrolytically deposited metallic layer which is subsequently stripped off the substrate, the improvement wherein the substrate has a cylindrical surface and is provided with the dot pattern by being rotated at constant speed about an axis while a nozzle sweeping across said surface at close distance therefrom and in a relative axial direction is intermittently actuated under the control of signals derived from the concurrent scanning of a master to discharge a hardenable substance in a programmed succession of short spurts onto said substrate.

2. The improvement defined in claim 1 wherein the master is mounted during scanning on a cylinder rotating at a speed related to that of the substrate.

3. The improvement defined in claim 1 or 2 wherein the master is repeatedly scanned during a sweeping of different axial zones of the substrate by the nozzle whereby the same dot pattern is formed on each of said zones.

4. The improvement defined in claim 1 or 2 wherein said substance is squirted from said nozzle under pressure of supersonic vibrations.

5. The improvement defined in claim 1 or 2 wherein an expanding agent is admixed with said substance prior to its discharge.

* * * * *

UNITED STATES PATENT AND TRADEMARK OFFICE

CERTIFICATE OF CORRECTION

PATENT NO. : 4 182 660

DATED : 8 January 1980

INVENTOR(S) : Peter Zimmer et al

It is certified that error appears in the above-identified patent and that said Letters Patent are hereby corrected as shown below:

In the heading, left column, item [30], correct the priority document No. to read: -- 2705/77 --.

Signed and Sealed this

*Eighth* Day of *July 1980*

[SEAL]

*Attest:*

SIDNEY A. DIAMOND

*Attesting Officer*

*Commissioner of Patents and Trademarks*